US010096949B2

(12) United States Patent
Zhang et al.

(10) Patent No.: US 10,096,949 B2
(45) Date of Patent: Oct. 9, 2018

(54) ELECTRICAL CONNECTOR HAVING INCLINED SHELL WITH SIDE-BY-SIDE LEGS

(71) Applicant: FOXCONN INTERCONNECT TECHNOLOGY LIMITED, Grand Cayman (KY)

(72) Inventors: Teng-Fei Zhang, Kunshan (CN); Jian-Kuang Zhu, Kunshan (CN); Kuo-Chun Hsu, New Taipei (TW)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/828,355

(22) Filed: Nov. 30, 2017

(65) Prior Publication Data

US 2018/0151986 A1 May 31, 2018

(30) Foreign Application Priority Data

Nov. 30, 2016 (CN) ..... 2016 2 1304253 U

(51) Int. Cl.

| | |
|---|---|
| ***H01R 13/658*** | (2011.01) |
| ***H01R 13/6582*** | (2011.01) |
| ***H01R 12/71*** | (2011.01) |
| ***H01R 13/502*** | (2006.01) |
| ***H01R 13/516*** | (2006.01) |
| ***H01R 13/627*** | (2006.01) |
| *H01R 24/60* | (2011.01) |

(Continued)

(52) U.S. Cl.

CPC ..... *H01R 13/6582* (2013.01); *H01R 12/712* (2013.01); *H01R 12/716* (2013.01); *H01R 13/502* (2013.01); *H01R 13/516* (2013.01); *H01R 13/6275* (2013.01); *H01R 12/707* (2013.01); *H01R 24/60* (2013.01); *H01R 2107/00* (2013.01)

(58) Field of Classification Search

CPC ..... H01R 13/6581; H01R 13/6582; H01R 13/6594; H01R 13/6595

See application file for complete search history.

(56) References Cited

U.S. PATENT DOCUMENTS

| | | | | |
|---|---|---|---|---|
| 9,099,811 | B2 * | 8/2015 | Simmel | H01R 13/64 |
| 9,755,370 | B2 * | 9/2017 | Little | H01R 13/6581 |

(Continued)

FOREIGN PATENT DOCUMENTS

| | | |
|---|---|---|
| CN | 204391417 U | 6/2015 |
| CN | 204947169 U | 1/2016 |

(Continued)

*Primary Examiner* — Ross Gushi

(74) *Attorney, Agent, or Firm* — Wei Te Chung; Ming Chieh Chang

(57) ABSTRACT

An electrical connector includes an insulative housing, a number of terminals received in the insulative housing, an inner shell and an outer shell. The insulative housing includes a base portion and a mating portion extending from the base portion in a mating direction. The base portion includes a mounting face inclined to the mating direction. The inner shell covers the insulative housing. The inner shell includes a number of first mounting legs, and the outer shell includes a number of second mounting legs. The second mounting legs and the first mounting legs are arranged in a side-by-side way.

20 Claims, 8 Drawing Sheets

(51) Int. Cl.
*H01R 12/70* (2011.01)
*H01R 107/00* (2006.01)

(56) References Cited

U.S. PATENT DOCUMENTS

| | | | | |
|---|---|---|---|---|
| 9,799,995 | B1 * | 10/2017 | Zhou | H01R 13/659 |
| 9,806,446 | B2 * | 10/2017 | Lee | H01R 12/71 |
| 9,806,467 | B2 * | 10/2017 | Long | H01R 13/659 |
| 9,853,393 | B2 * | 12/2017 | Guo | H01R 13/5219 |
| 9,935,398 | B2 * | 4/2018 | Yokoyama | H01R 13/631 |
| 2016/0020537 | A1 * | 1/2016 | Ju | H01R 24/78 439/83 |

FOREIGN PATENT DOCUMENTS

| | | | |
|---|---|---|---|
| CN | 205565050 | U | 9/2016 |
| CN | 205646271 | U | 10/2016 |
| TW | M350855 | | 2/2009 |

* cited by examiner

ELECTRICAL CONNECTOR HAVING INCLINED SHELL WITH SIDE-BY-SIDE LEGS

BACKGROUND OF THE DISCLOSURE

1. Field of the Disclosure

The invention is related to an electrical connector, and particularly to the electrical connector having an mating portion incline to a mounting face.

2. Description of Related Arts

U.S. Pat. No. 7,811,131 discloses an electrical connector having an insulative housing, a plurality of terminals received in the insulative housing, an inner shell and an outer shell. The inner shell and the outer shell cover the insulative housing. The insulative housing includes a base portion and a mating portion extending from the base portion. The base portion has a mounting face and a top face opposite to the mounting face. The mating portion extends from the top face in a direction incline to the mounting face. The outer shell includes a plurality of mounting legs to mount onto a printed circuit board vertically. The electrical connector is mounted onto the printed circuit board in an inclined way. Therefore, the retention force between the electrical connector and the printed circuit board is poor.

It is desired to provide an improved electrical connector.

SUMMARY OF THE DISCLOSURE

To achieve the above desire, an electrical connector defining a mating direction comprises an insulative housing, a plurality of terminals received in the insulative housing, an inner shell and an outer shell. The insulative housing includes a base portion and a mating portion extending from the base portion in a mating direction. The base portion includes a mounting face incline to the mating direction. The inner shell covers the insulative housing. The inner shell includes a plurality of first mounting legs, and the outer shell includes a plurality of second mounting legs. The second mounting legs and the first mounting legs are arranged in a side-by-side way. Therefore, the retention force between the electrical connector and the printed circuit board is strong.

DETAILED DESCRIPTION OF THE PREFERRED EMBODIMENT

Figure 1:
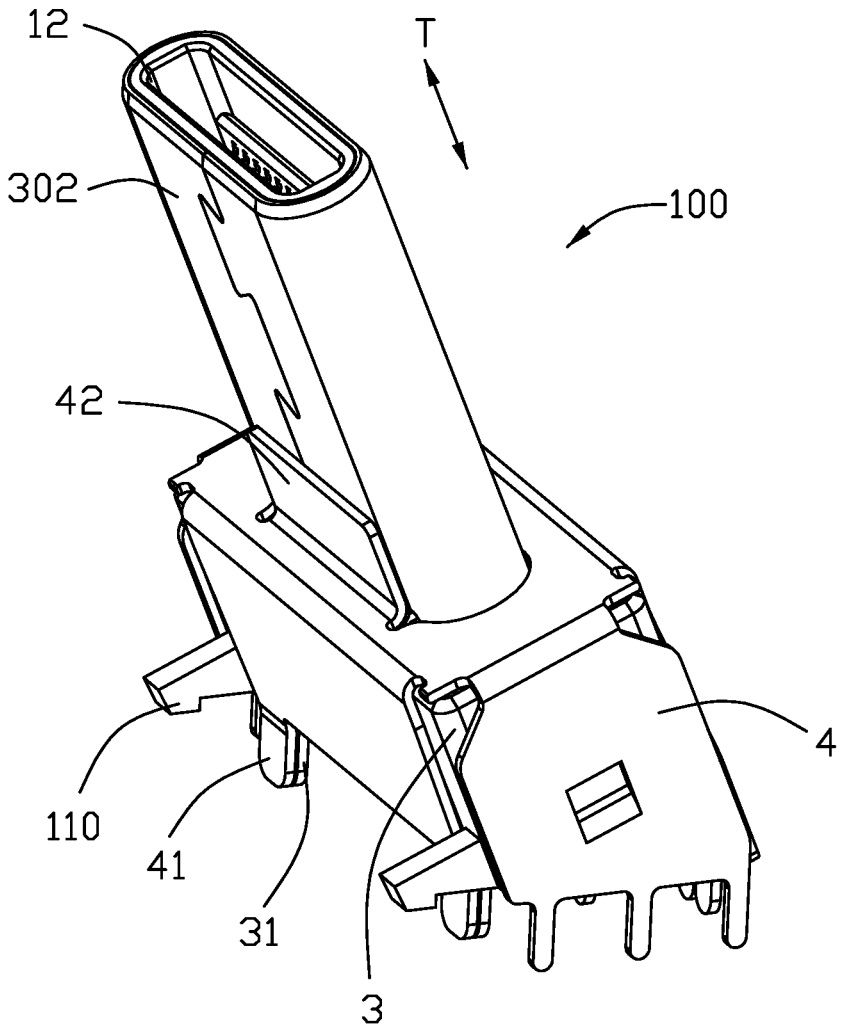
FIG. 1 is a perspective view of an electrical connector according to the invention.
Figure 2:
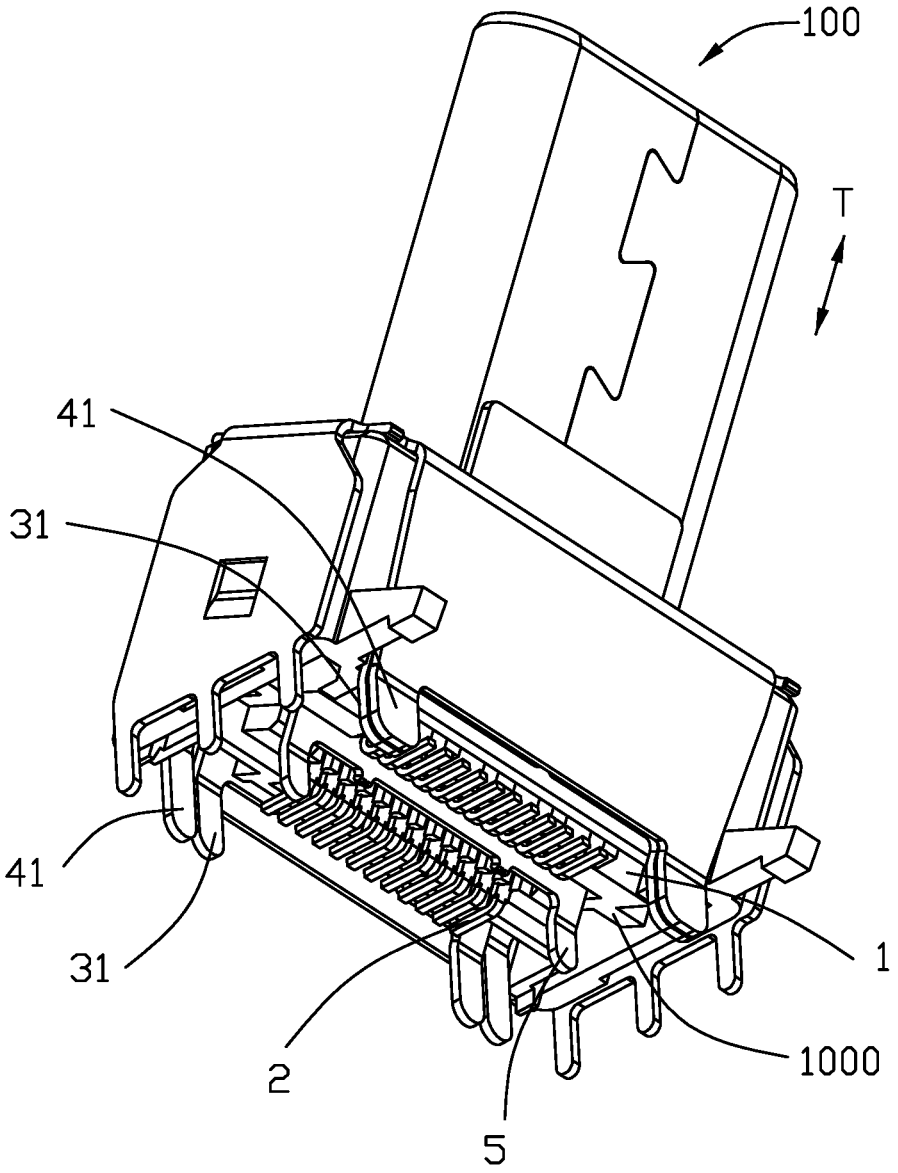
FIG. 2 is another perspective view of the electrical connector of FIG. 1.
Figure 6:
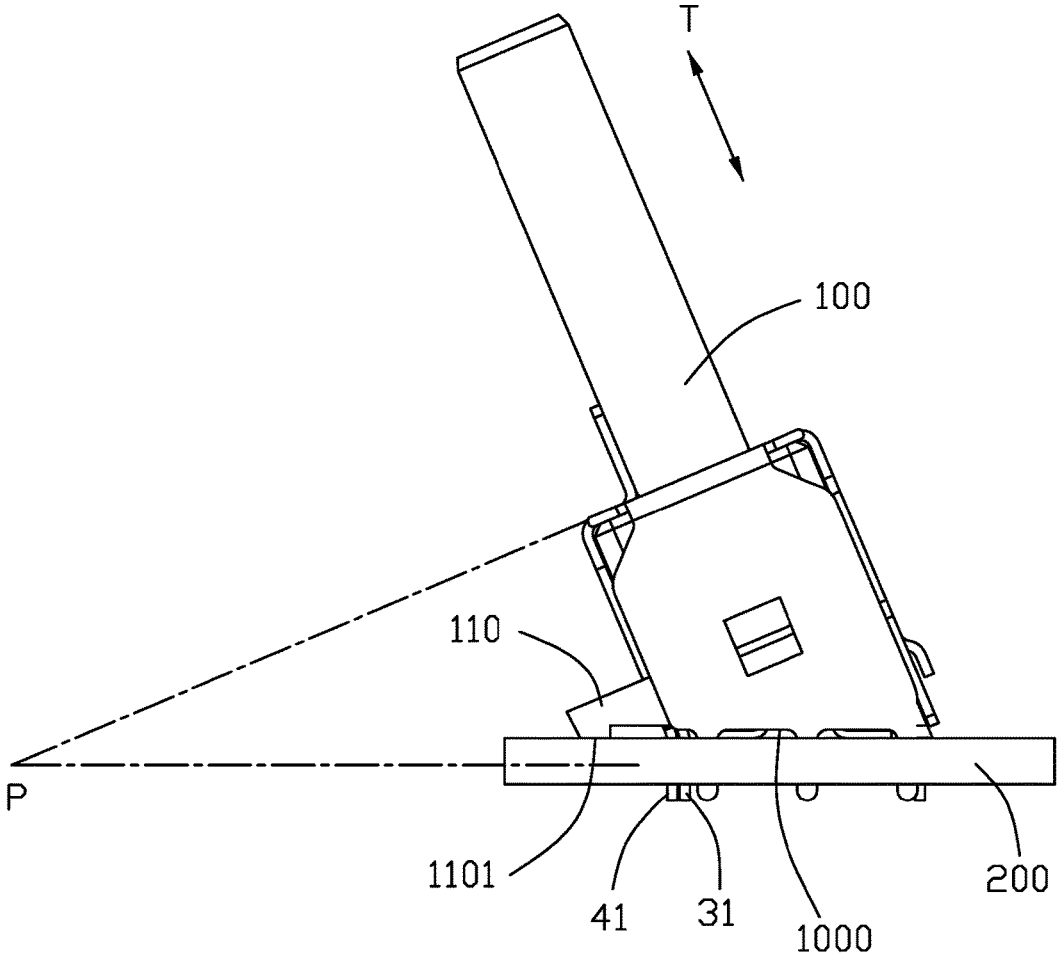
FIG. 6 is a side view of the electrical connector mounted onto the printed circuit board.

Reference will now be made in detail to the embodiments of the present disclosure. Referring to FIGS. 1-2 and 6, an electrical connector 100 is adapted for mounting to a PCB 200. The electrical connector 100 includes an insulative housing 1, a plurality of terminals 2 received in the insulative housing 1, a metal latch 5 extending along a mating direction T, an inner shell 3 and an outer shell 4. The inner shell 3 and the outer shell 4 cooperated to cover the insulative housing 1. The electrical connector 100 has a mounting face 1000 extending horizontally, and the mating direction T is incline to the mounting face. The inner shell 3 includes a plurality of first/inner mounting legs 31 extending downwardly. The outer shell 4 includes a plurality of second/outer mounting legs 41 extending downwardly. The first mounting legs 31 and the second mounting legs 41 are arranged in a side-by-side way. Therefore, the electrical connector 100 is mounted onto the PCB 200 steadily.

Figure 3:
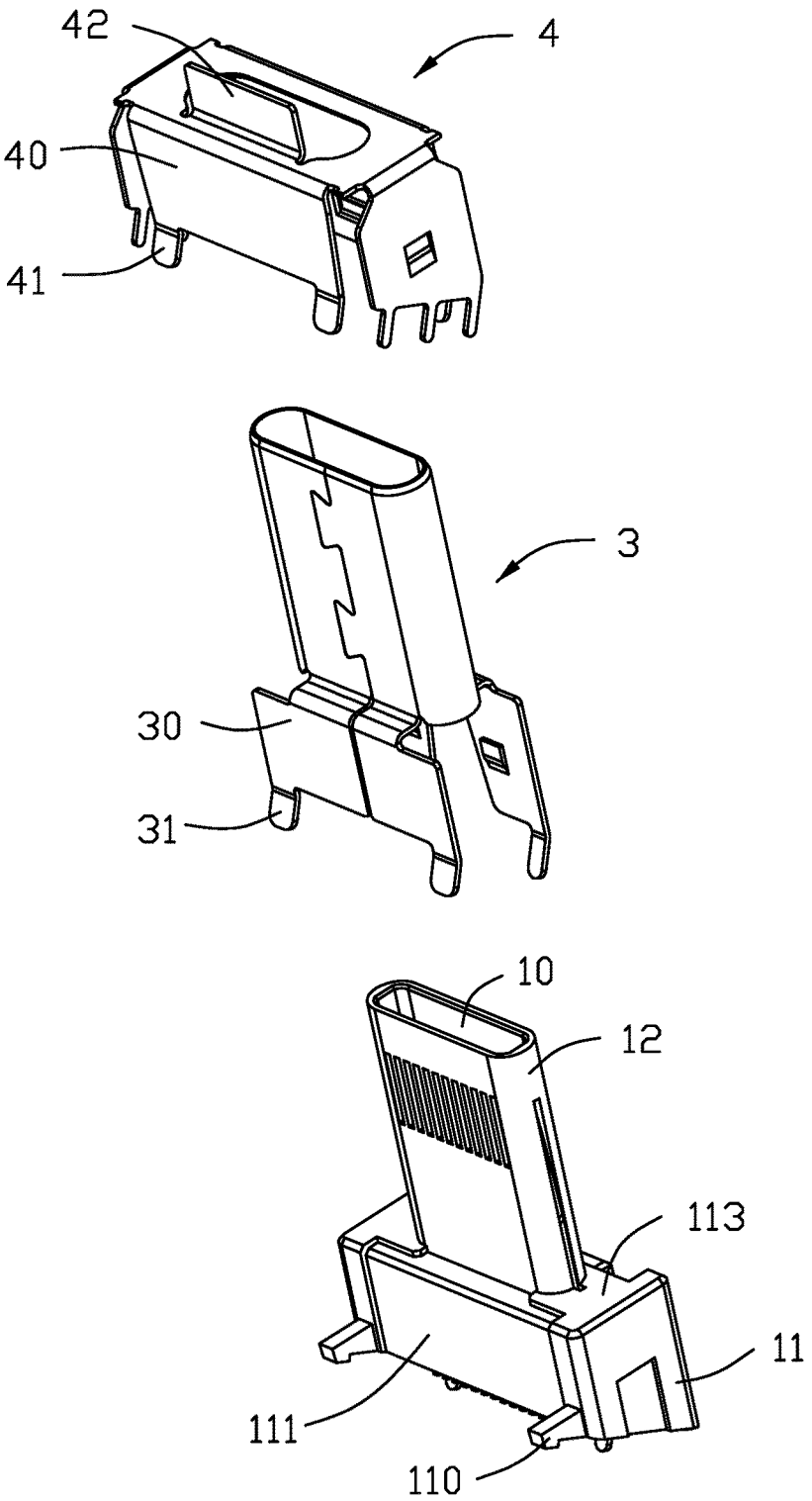
FIG. 3 is an exploded perspective view of the electrical connector of FIG. 1.
Figure 4:
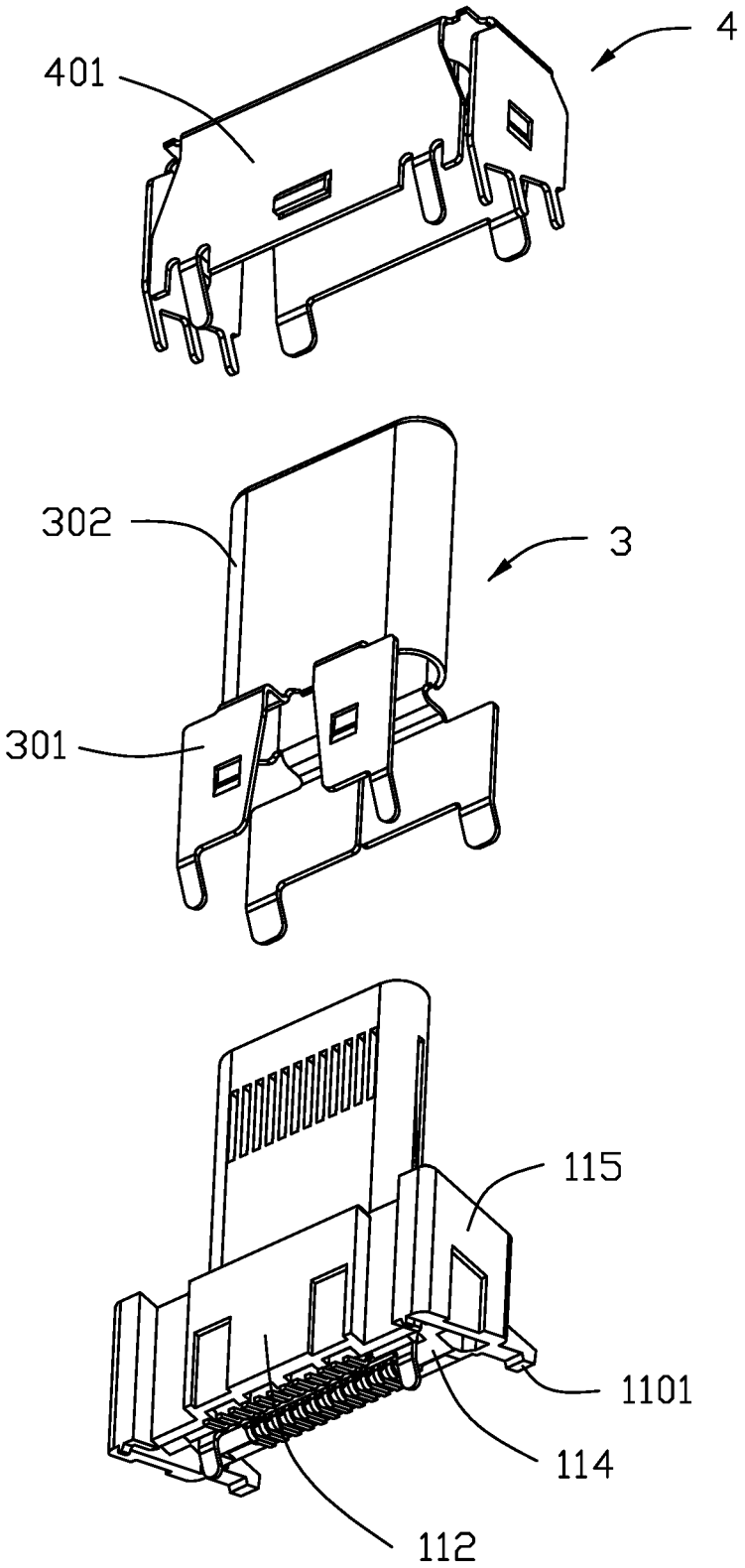
FIG. 4 is another exploded perspective view of the electrical connector of FIG. 3.
Figure 5:
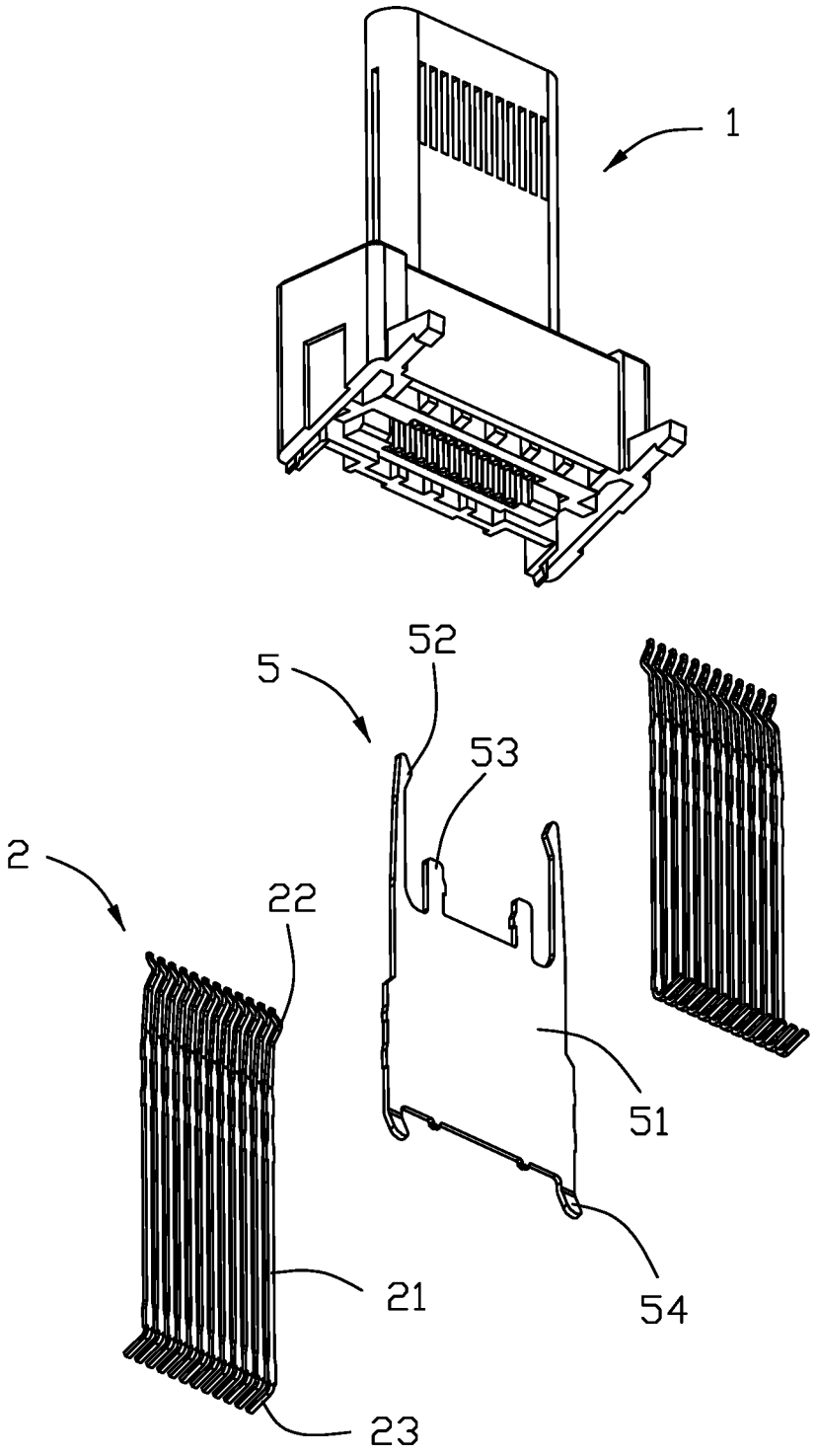
FIG. 5 is a perspective view of the insulative housing, the terminals and the metal latch of the electrical connector of FIG. 3.

Referring to FIGS. 3-5, the insulative housing 1 includes a base portion 11 and a mating portion 12 extending therefrom along the mating direction T. The base portion 11 includes a bottom face 114, a top face 113 opposite to the bottom face 114, a first face 111 connecting the bottom face 114 and the top face 113, a second face 112 opposite to the first face 111 and two side faces 115 connecting the first face 111 and the second face 112. The bottom face 114 is defined as the mounting face 1000. The mounting face 1000 is oblique to the first face 111, the second face 112, the bottom face 114 and the top face 113. The mating portion 12 extends from the top face 113 in the mating direction T. A length of the first face 111 is smaller than a length of the second face 112. The mating portion 12 is shaped as a tongue plate structure. The terminals 2 expose downwardly out of a surface of the mating portion 12. In this embodiment, the mating portion 12 is shaped as a hollow sleeve structure. The mating portion 12 includes a mating cavity 10 opening in the mating direction T. Each of the terminals 2 includes a fixing portion 21 fixed in the base portion 11, an elastic contacting portion 22 extending into the cavity 10 and a soldering foot 23 extending beyond the mounting face 1000. The soldering foot 23 can be soldered onto the PCB 200 by a Surface Mounted Technology (SMT). The soldering foot 23 can also be soldered into the PCB 200 by a through hole way. The metal latch member 5 is mounted into the insulative housing 1 through the mounting face 1000. In the mating direction T, the metal latch member 5 includes a main portion 51 shaped as a plate structure received in the insulative housing 1, a pair of latch arms 52 extending upwardly from two sides of the main portion 51 into the mating cavity 10, a pair of fixing arms 53 extending upwardly from the main portion 51 and fixed in the insulative housing 1 and a connecting portion 54 extending downwardly from the main portion 51 and beyond the mounting face 1000. The connecting portion 54 is mounted onto the PCB 200.

Referring to FIG. 6, the base portion 11 includes a supporting portion 110 extending beyond the first face 111. The supporting portion 110 includes a supporting face 1101 to support on an upper face of the printed circuit board 200. In this embodiment, the supporting portion 110 extends from the first face 111. In other embodiments, the supporting portion 110 can also be disposed in other ways. The supporting portions 110 can enhance installation stability of the electrical connector 100.

Referring to FIGS. 1-4, the inner shell 3 includes an inner main portion 30 covering the insulative housing 1. The inner main portion 30 includes a first main portion 301 covering the base portion 11 and a mating frame 302 extending upwardly from the first main portion 301 in the mating direction T. The mating frame 302 covers the mating portion 12. The outer shell 4 includes an outer main portion 40 covering the insulative housing 1. The outer main portion 40 covers the inner shell 3. The outer main portion 40 includes an abutment portion 42 to abut against the inner shell 3. The inner shell 3 includes a first main portion 301 covering the base portion 11 and a mating frame 302 extending upwardly from the first main portion 301 in the mating direction T. The mating frame 302 covers the mating portion 12. The outer shell 4 includes a second main portion 401 covering the first main portion 301 and the abutment portion 42 extending from the second main portion 401 in the mating direction T. The abutment portion 42 is shaped as a plate structure. The abutment portion 42 abuts against an outer face of the mating frame 302. This can enhance retention force between the mating portion 12 and the mating frame 302.

Each of the first/inner mounting leg 31 and the second/outer mounting leg 41 is shaped/configured with a plate structure. The first mounting leg 31 and the second mounting leg 41 can be arranged in a side-by-side way in the thickness/front-to-back direction thereof. The first mounting leg 31 and the second mounting leg 41 can also be arranged in a side-by-side way in the width direction thereof. The first mounting leg 31 and the second mounting leg 41 are mounted into a same hole of the printed circuit board 200. In this embodiment, the first mounting leg 31 is bent from the inner main portion 30 and mounted onto the printed circuit board 200 vertically, and the second mounting leg 41 is also bent from the outer main portion 40 and mounted onto the printed circuit board 200 vertically. The length of the first mounting leg 31 and the second mounting leg located around the first face 111 is smaller than the length of the first mounting leg 31 and the second mounting leg located around the second face 112. The first mounting leg 31 and the second mounting leg 41 are arranged in a side-by-side way in the thickness direction located around the first face 111. The first mounting leg 31 and the second mounting leg 41 are arranged in a side-by-side way in the width/transverse direction located around the second face 112. Through aforesaid structure, this can enhance an improved supporting capability and an improved installation stability of the electrical connector 100. Notably, the thickness/front-to-back direction is perpendicular to the width/transverse direction, and both of which are perpendicular to the vertical direction with regard to the printed circuit board 200.

Figure 7:
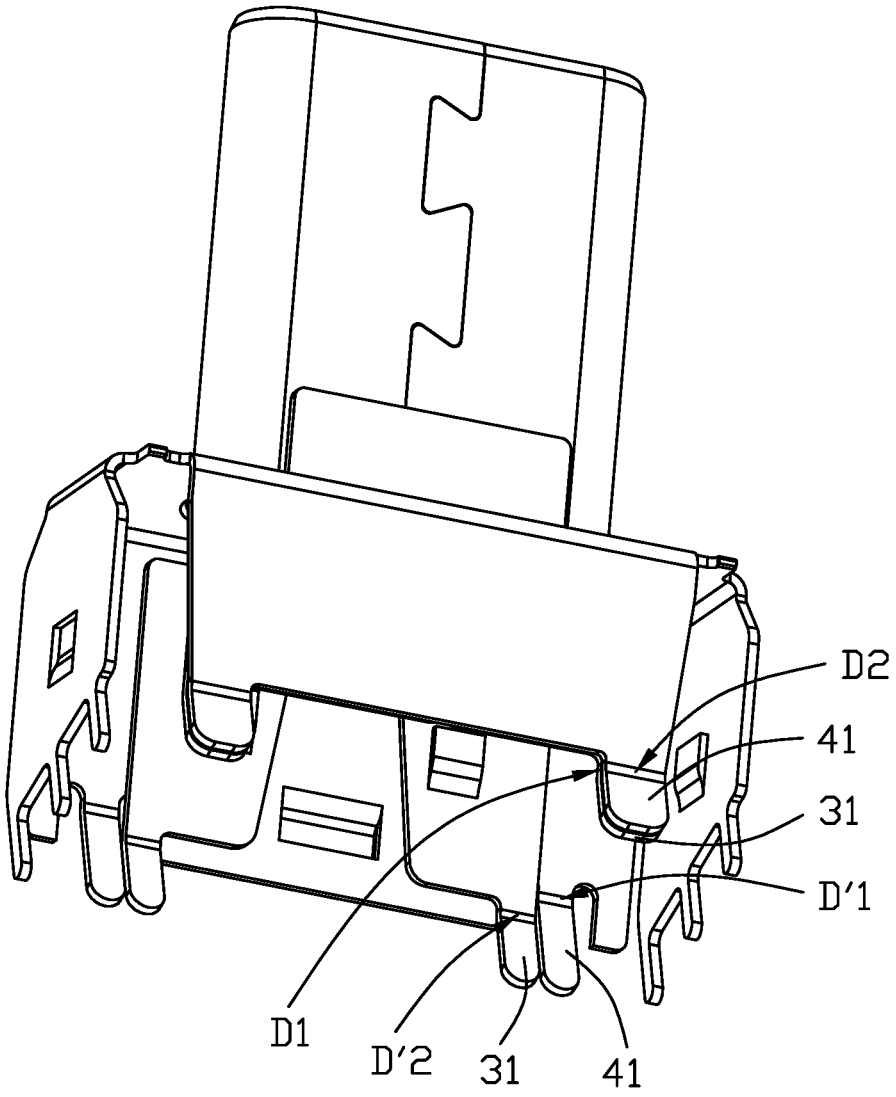
FIG. 7 is perspective view of the electrical connector of FIG. 1 without the housing and the terminals therein to show the relation between the inner shell and the outer shell.
Figure 8:
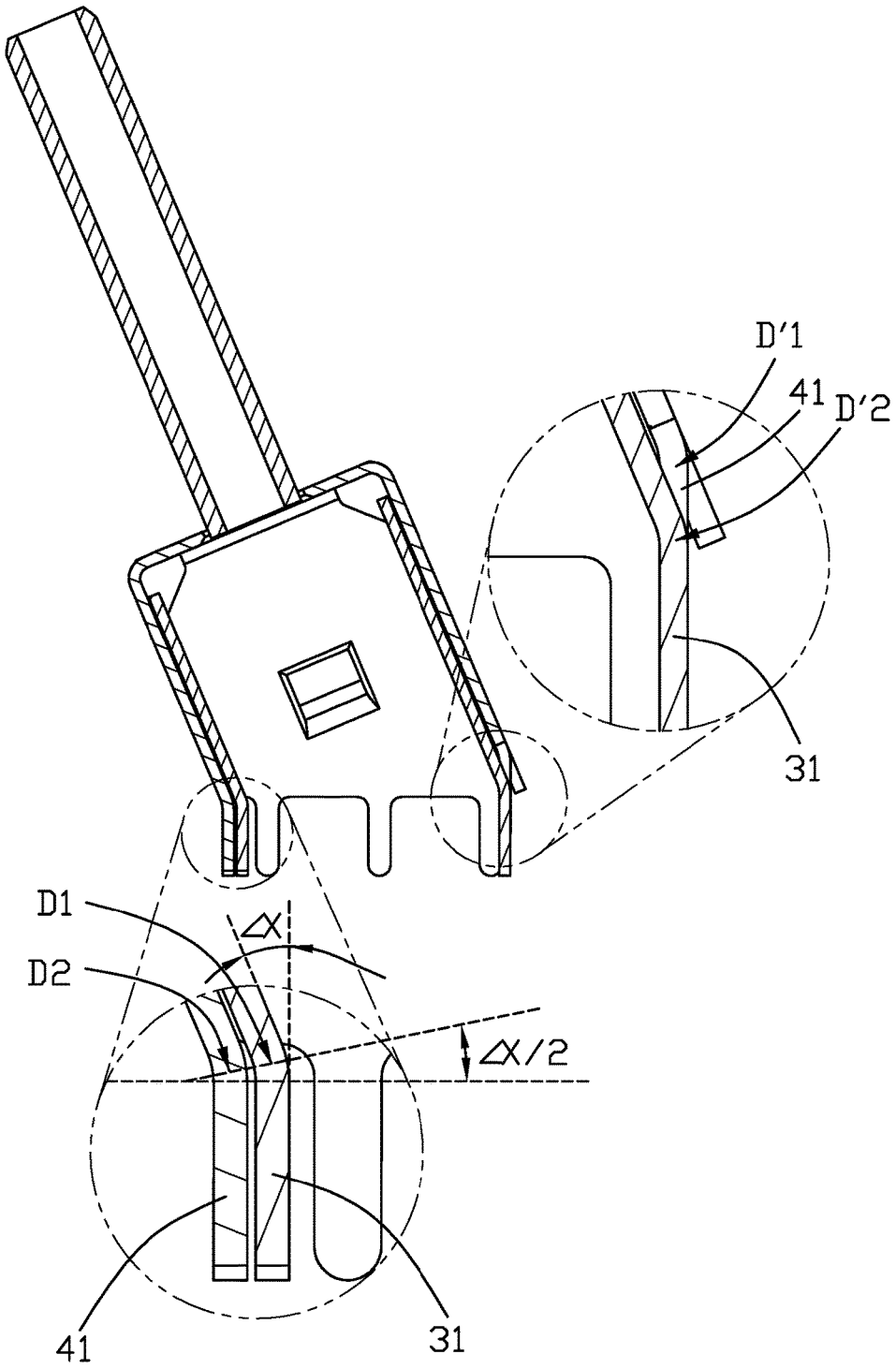
FIG. 8 is a cross-sectional view of the electrical connector of FIG. 1 without the housing and the terminals to show the relation between the side-by-side arranged mounting legs of the inner shell and the outer shell.

From a side view, the housing may be deemed with the high/large wall/face 112 and a low/small wall/face 111 with regard to the PCB 200 wherein the plane defined by the top face 113 of the housing 1 intersects with the PCB 200 at the line/point labeled with intersecting point P as shown in the side view in FIG. 2, and the low/small wall 111 is closer to the intersection line P than the high/large wall 112. Correspondingly, the inner shell 3 also forms a high/large wall 302 and the low/small wall 301 to cover the corresponding high/large wall 112 and low/small wall 111. Similarly and correspondingly, the outer shell 4 also forms a high/large plate 402 and a low/small plate 401 to cover the high/large wall 302 and the low/small wall 301. In a detailed analysis and in a micro viewpoint, referring to FIGS. 7-8, in this embodiment for the side-by-side arrangement in the thickness direction, the mounting leg 31 is bent with regard to the main portion 301 at an angle of X degrees and the mounting leg 41 is also bent with regard to the main portion 401 at the same angle of X degrees while the imaginary bending line/axis extends along a direction with an angle equal of X/2 degrees theoretically. Under this situation, the mounting leg 31 should be dimensioned longer, in the vertical direction, than the mounting leg 41 when both ends of the mounting leg 31 and the mounting leg 41 are flush with each other in the same through hole in the PCB 200. In other words, for the side-by-side arranged mounting legs in the thickness direction, the mounting leg farther away from the intersection line/point P (FIG. 6) is slightly longer than the other in the vertical direction. It is because the deflection point D1 of the farther mounting leg is slightly higher than the deflection point D2 of the near mounting leg. Similarly, for the side-by-side arranged mounting legs in the width direction, the mounting leg extending from the farther wall has a deflection point D'1 higher than the deflection point D'2 of the mounting leg extending from the near wall.

While a preferred embodiment in accordance with the present disclosure has been shown and described, equivalent modifications and changes known to persons skilled in the art according to the spirit of the present disclosure are considered within the scope of the present disclosure as described in the appended claims.

What is claimed is:

1. An electrical connector used to mounted onto a PCB, comprising:

an insulative housing including a base portion and a mating portion extending from the base portion in a mating direction, the base portion having a mounting face inclined to the mating direction;

a plurality of terminals received in the insulative housing;

an inner shell covering the insulative housing and having a plurality of first mounting legs; and an outer shell having a plurality of second mounting legs; wherein the second mounting legs and the first mounting legs are arranged in a side-by-side way.

2. The electrical connector as claimed in claim 1, wherein the first mounting legs and the second mounting legs are both shaped as a tongue plate structure, and the first mounting legs and the second mounting legs are arranged in a side-by-side way in a thickness direction.

3. The electrical connector as claimed in claim 1, wherein the first mounting legs and the second mounting legs are both shaped as a tongue plate structure, and the first mounting legs and the second mounting legs are arranged in a side-by-side way in a width direction.

4. The electrical connector as claimed in claim 1, wherein the first mounting legs and the second mounting legs are mounted into a same hole of the PCB.

5. The electrical connector as claimed in claim 1, wherein the inner shell includes an inner main portion covering the insulative housing, the outer shell includes an outer main portion covering the insulative housing, the first mounting legs are bent from the inner main portion to mount onto the PCB vertically, and the second mounting legs are also bent from the outer main portion to mount onto the PCB vertically.

6. The electrical connector as claimed in claim 1, wherein the base portion has a first face, a second face opposite to the first face and a top face opposite the mounting face, the first face and the second face connect the top face and the mounting face, the mating portion extends from the top face in the mating direction, and the length of the first face is smaller than the length of the second face.

7. The electrical connector as claimed in claim 6, wherein the length of the first mounting legs located around the first face is smaller than the length of the first mounting legs located around the second face, and the length of the second mounting legs located around the first face is smaller than the length of the second mounting legs located around the second face.

8. The electrical connector as claimed in claim 6, wherein the first mounting legs and the second mounting legs located around the first face are arranged in a side-by-side way in a thickness direction, and the first mounting legs and the second mounting legs located around the second face are arranged in a side-by-side way in a width direction.

9. The electrical connector as claimed in claim 6, wherein the inner shell includes a first main portion covering the base portion and a mating frame extending from the first main portion in the mating direction, the mating frame covers the mating portion, and the outer shell includes a second main portion covering the first main portion and an abutment portion extending from the second main portion in the mating direction, and the abutment portion abuts against an outer face of the mating frame.

10. The electrical connector as claimed in claim 6, wherein the base portion includes a supporting portion extending from the first face.

11. An electrical connector assembly comprising:

a printed circuit board;

an electrical connector mounted upon the printed circuit board in an oblique manner, said electrical connector defining a mating direction oblique to the printed circuit board so as to have an imaginary plane defined by a top face of the connector intersect with another imaginary plane defined by the printed circuit board at an imaginary intersecting point;

an insulative housing associated with a plurality of terminals therein;

a metallic inner shell enclosing the housing and including an inner main portion with at least one inner mounting leg deflected with regard to the inner main portion and extending downwardly therefrom into the printed circuit board in a vertical direction; and a metallic outer shell enclosing the inner shell and including an outer main portion with at least one outer mounting leg deflected with regard to the outer main portion and extending downwardly therefrom into the printed circuit board in the vertical direction; wherein said inner mounting leg and said outer mounting leg are intimately side-by-side arranged with each other along either a thickness direction or a width direction of the inner mounting leg and the outer mounting leg, said thickness direction and said width direction being perpendicular to each other and both perpendicular to the vertical direction.

12. The electrical connector assembly as claimed in claim 11, wherein the inner mounting leg and the outer mounting leg are intimately side-by-side arranged with each other in the width direction which is a transverse direction with regard to the printed circuit board.

13. The electrical connector assembly as claimed in claim 11, wherein the inner mounting leg and the outer mounting leg are intimately side-by-side arranged with each other in the thickness direction which is a front-to-back direction with regard to the printed circuit board.

14. The electrical connector assembly as claimed in claim 13, wherein one of the inner mounting leg and the outer mounting leg, which is farther from the imaginary intersecting point than the other of the inner mounting leg and the outer mounting leg, has a deflection point higher than that of the other in the vertical direction.

15. The electrical connector assembly as claimed in claim 14, wherein said one of the inner mounting leg and the outer mounting leg is the inner mounting leg.

16. The electrical connector assembly as claimed in claim 13, wherein one of the inner mounting leg and the outer mounting leg, which is extending from one of the inner main portion and the outer main portion farther from the imaginary intersecting point than the other of the inner main portion and the outer main portion, has a deflection point higher than that of the other in the vertical direction.

17. The electrical connector assembly as claimed in claim 16, wherein said one of the inner mounting leg and the outer mounting leg is the outer mounting leg.

18. An electrical connector adapted for mounting to a printed circuit board and equipped with a mating direction oblique to the printed circuit board, comprising:

an insulative housing associated with a plurality of terminals therein;

a metallic inner shell enclosing the housing and including an inner main portion with at least one inner mounting leg deflected with regard to the inner main portion and extending downwardly therefrom into the printed circuit board in a vertical direction; and a metallic outer shell enclosing the inner shell and including an outer main portion with at least one outer mounting leg deflected with regard to the outer main portion and extending downwardly therefrom into the printed circuit board in the vertical direction; wherein said inner mounting leg and said outer mounting leg are intimately side-by-side arranged with each other along either a thickness direction or a width direction of the inner mounting leg and the outer mounting leg, said thickness direction being perpendicular to each other and both perpendicular to the vertical direction.

19. The electrical connector as claimed in claim 18, wherein said inner mounting leg and said outer mounting leg are side-by-side intimately arranged with each other in the thickness direction, and one of said inner mounting leg and said outer mounting leg has a higher deflection point than the other in the vertical direction.

20. The electrical connector as claimed in claim 18, wherein said inner mounting leg and said outer mounting leg are side-by-side intimately arranged with each other in the width direction, and one of said inner mounting leg and said outer mounting leg has a higher deflection point than the other in the vertical direction.

* * * * *